US005893431A

United States Patent [19]

Cranswick et al.

[11] Patent Number: 5,893,431

[45] Date of Patent: Apr. 13, 1999

[54] BASEMENT EMERGENCY EXIT ASSEMBLY

[76] Inventors: David Maxwell Cranswick, 189 Aylesworth Avenue, Scarborough, Ontario, Canada, M1N 2J9; Keith S.J. Neumark, 23 Greypoint Drive, Scarborough, Ontario, Canada, M1B 1L9

[21] Appl. No.: 09/010,196

[22] Filed: Jan. 21, 1998

[30] Foreign Application Priority Data

Jan. 21, 1997 [CA] Canada ..... 2195586

[51] Int. Cl.[6] ..... E06C 9/14

[52] U.S. Cl. ..... 182/70; 182/76; 182/77; 49/141

[58] Field of Search ..... 182/70, 74, 76, 182/77; 49/141

[56] References Cited

U.S. PATENT DOCUMENTS

| | | | |
|---|---|---|---|
| 3,997,026 | 12/1976 | Richlmann | 182/70 |
| 4,434,871 | 3/1984 | Niedworok . | |
| 4,445,589 | 5/1984 | Longenecker . | |
| 4,495,728 | 1/1985 | Lynn . | |
| 5,070,963 | 12/1991 | Fusco . | |
| 5,467,841 | 11/1995 | Krumal | 182/70 |
| 5,603,183 | 2/1997 | Giovinazzi . | |
| 5,605,205 | 2/1997 | Douglas et al. . | |

*Primary Examiner*—Alvin Chin-Shue

[57] ABSTRACT

A basement emergency exit assembly has a ladder for exiting from a basement window. The window is held within tracks mounted at the interior of the window frame. By moving the bottom of the ladder away from the wall, the window is permitted to slide down the track out of its frame and the ladder is positioned at an angle for easy egress. The window can either fall directly into a pocket within a wall, or, the tracks can be swung out as the ladder is moved thereby pulling the window out of frame and causing it to slide along the tracks until it is clear of the window opening.

6 Claims, 6 Drawing Sheets

BASEMENT EMERGENCY EXIT ASSEMBLY

FIELD OF THE INVENTION

The present invention generally relates to emergency exits. Specifically, the present invention relates to emergency exits from basements.

BACKGROUND OF THE INVENTION

Various designs of emergency exits exist to allow occupants to escape from upper floors of buildings when an emergency, such as a fire, arises. These known emergency exits include crash doors, exterior staircases and extensible ladders. Generally, fire doors and exits are both clearly marked by signs and contain crash handles to allow a simple, understandable escape from a building. They provide security from intruders and a one step release to eliminate confusion or complicated hardware to unlock and open.

While the emergency exits described above are sufficient for escape from the upper and main floors of a building, they are not capable of providing a safe exit from a basement, or below grade, dwelling. Basement apartments, or living areas, have enjoyed a strong increase in most large urban centers in recent years. Typically, basement apartments are built within previously existing houses. Generally, access to the apartment is from an upper floor, by way of an interior staircase. Most apartments, especially those crated within a pre-existing basement, tend to have relatively small windows located high on the wall, nearly at the ceiling.

As is known, exposure to smoke caused by a fire is the most common cause of death and injury to occupants and firefighters. Standard fire safety necessitates that a person stay as low to the floor as possible in a fire to avoid being overcome by the smoke. It is also generally accepted that fire and smoke are disorienting and panic-inducing. Therefore, emergency exits need to be as simple as possible to operate and find. Basement apartments do not, generally, include an emergency exit. It is necessary for occupants faced with a fire, or other emergency, to either exit the building by ascending the staircase to an upper floor, or to access a basement window, unlock, remove or otherwise open the window and then crawl upwards out of the small opening provided. As is apparent, such prior art basement emergency exits expose an occupant to life threatening and unnecessary risks. The occupant must stand at the window to unlock and open the existing windows thereby exposing themselves to high heat and choking smoke conditions which would quickly disable and disorient the occupant and thus endanger their opportunity for escape.

The present inventors are not currently aware of any device which permits an occupant of a basement apartment to easily and reliably open a basement window area from the floor level where the occupant's best conditions for survival exist. Canadian Patent No. 1,116,571, entitled Basement Emergency Exit, provides a set of steps folded flat against a wall. To operate the exit, a tread is grabbed, thereby unfolding the steps. A complicated hinge mechanism simultaneously unlatches a window above the steps, and opens it outwards. The drawbacks of this device include the complexity of the mechanism automatically opening the window, the necessity to ensure that the window is in good operating condition, for example, ensuring that it has not been painted shut, the provision of a number of steps flush against the wall, which can be more difficult to climb than a sloped ladder or regular staircase, and the possibility that the window opening outwardly will be obstructed by snow or some object placed outside the window, thus blocking the exit.

SUMMARY OF THE INVENTION

It is an object of the present invention to provide a novel basement emergency exit assembly which obviates or mitigates at least one of the disadvantages of the prior art.

The present invention generally provides a basement window to which is attached a ladder to provide access to the window opening. Pulling the ladder inwardly from the bottom actuates a sliding mechanism which causes the window to slide in a generally downwardly direction, out of its outer frame. Pulling the ladder from the bottom also angles it away from the wall to provide a gently sloped exit to the window opening.

The simplicity and ease of the one step operation from the floor area allows children, elderly or handicapped people to open the window area quickly and the ladder allows a suitable climbing angle to assist in their escape through the basement window opening instead of searching for a chair or other article which they would be required to climb to a conventional window.

According to a first aspect of the present invention, there is provided a basement emergency exit assembly for use in an opening in a wall, said opening being provided with a frame, comprising:

a window slidably received within track means, said track means mounted within said frame;

a ladder, for exiting through said opening, whereby said ladder is operable to drop said window out of said frame by pulling an end of said ladder away from said wall thereby actuating an actuating mechanism interconnecting said ladder to said window.

BRIEF DESCRIPTION OF THE DRAWINGS

Preferred embodiments of the present invention will now be described, by way of example only, with reference to the attached Figures, in which.

DETAILED DESCRIPTION

Figure 1:
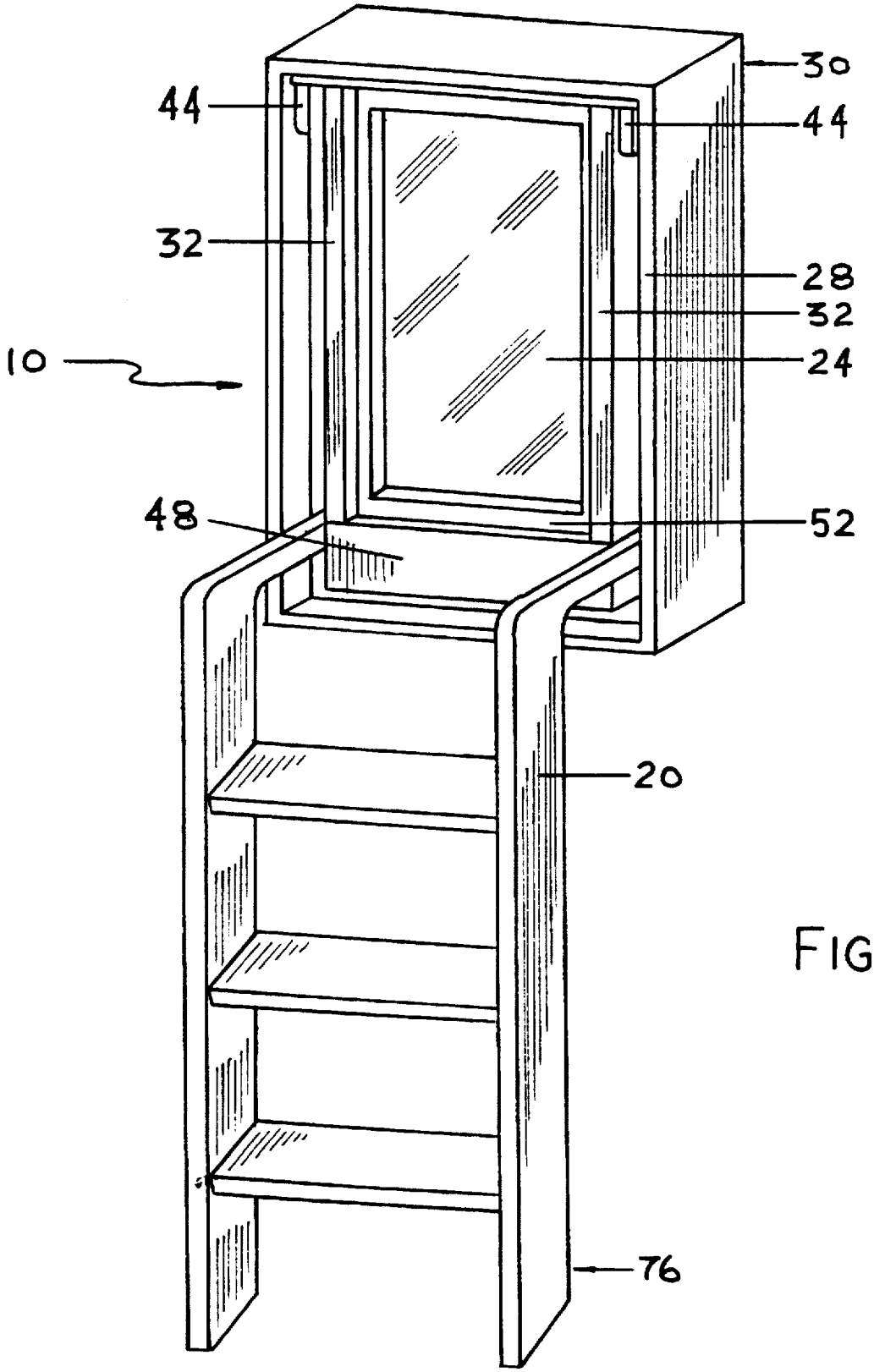
FIG. 1 is a perspective view of a basement emergency exit assembly in a closed position, in accordance with a first embodiment of the present invention.
Figure 2:
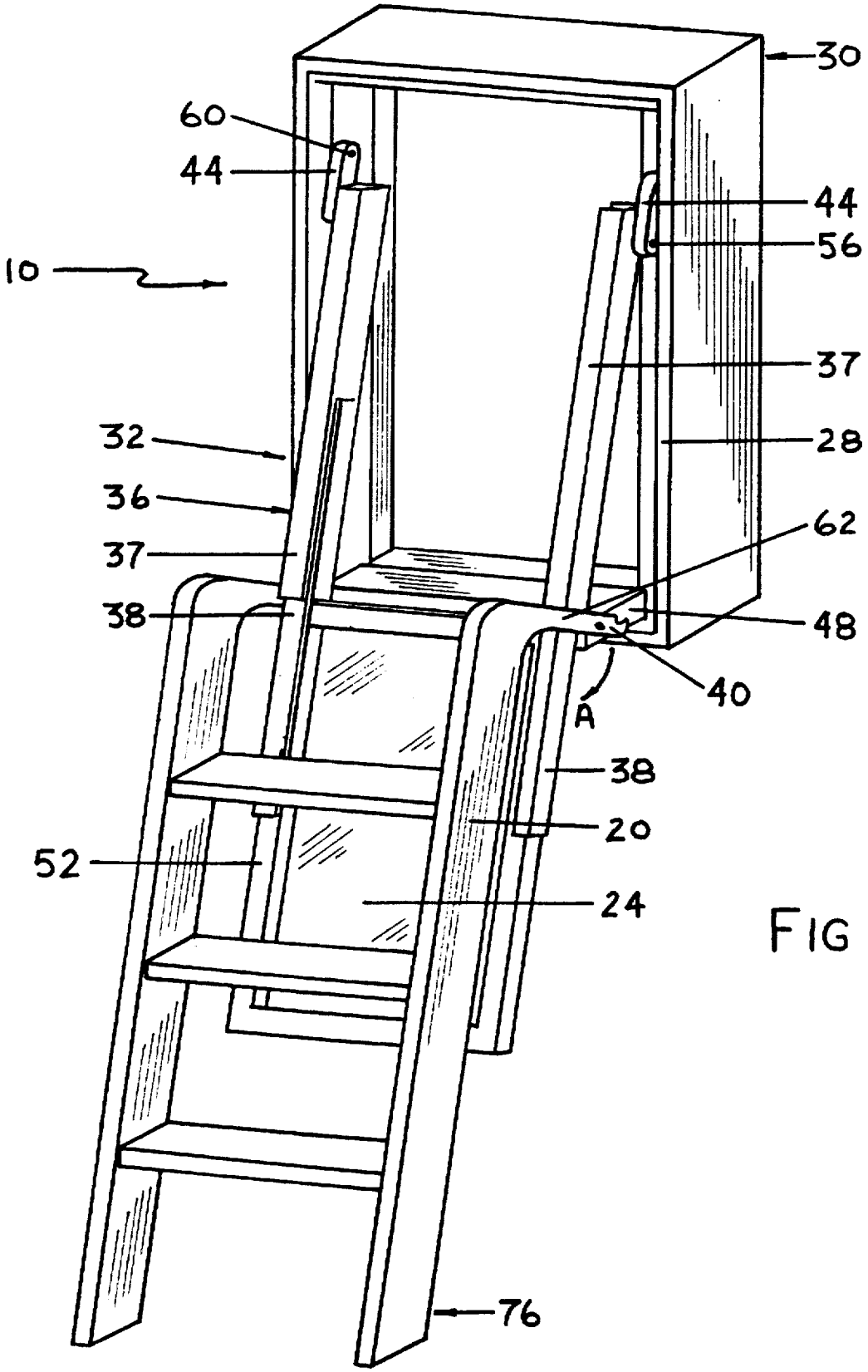
FIG. 2 is a perspective view of the assembly of FIG. 1 in an open position.

Referring to FIGS. 1 and 2, the basement emergency exit assembly of the present invention is generally designated as 10. Assembly 10 generally consists of a ladder 20, a window 24 mounted within an outer frame 28 of an opening 30, and a slider mechanism 32 linking ladder 20 to window 24. Opening 30 can be any opening in a foundation or wall of a building, or other structure, of a size sufficient to permit a person to crawl therethrough. Outer frame 28 will generally be a wood frame mounted in a conventional manner to the inner surface of opening 30, but can also be a metal or vinyl frame. While the present invention is described throughout as including a window, it is apparent that window 24 can be any suitable cover over opening 28, such as a panel which serves to conceal opening 28, and window is so defined herein. Window 24 can be any window of a slider type, or double hung style. Ladder 20 can be any suitable metal or wooden ladder with steps or rungs of a length sufficient to reach from the floor of a dwelling to the bottom sash of window 24.

Slider mechanism 32 generally consists of a set of opposing tracks 36 disposed on either side of window 24, locking mechanism 40, pivoting spacers 44 and drop panel 48. Tracks 36 are each a pair of nested U-shaped members 37 and 38 which retain side frame members 52 of window 24. The inner width of tracks 36 is sufficient to permit side frame members 52 to slide freely along there length when assembly 10 is actuated, as will be more fully described below. Pivoting spacers 44 are attached to the upper ends of tracks 36 by pins 56 and to the interior of frame 28 by pins 60, such that pivoting members 44 can rotate about both pins 56 and 60. Pivoting spacers 44 are short lengths of wood or metal which hold tracks 36 away from outer frame 28 and permit tracks 36 to drop and angle outwards, as will be more fully described below. Locking mechanism 40, and drop panel 48 generally constitute an actuating mechanism for assembly 10.

Figure 5:
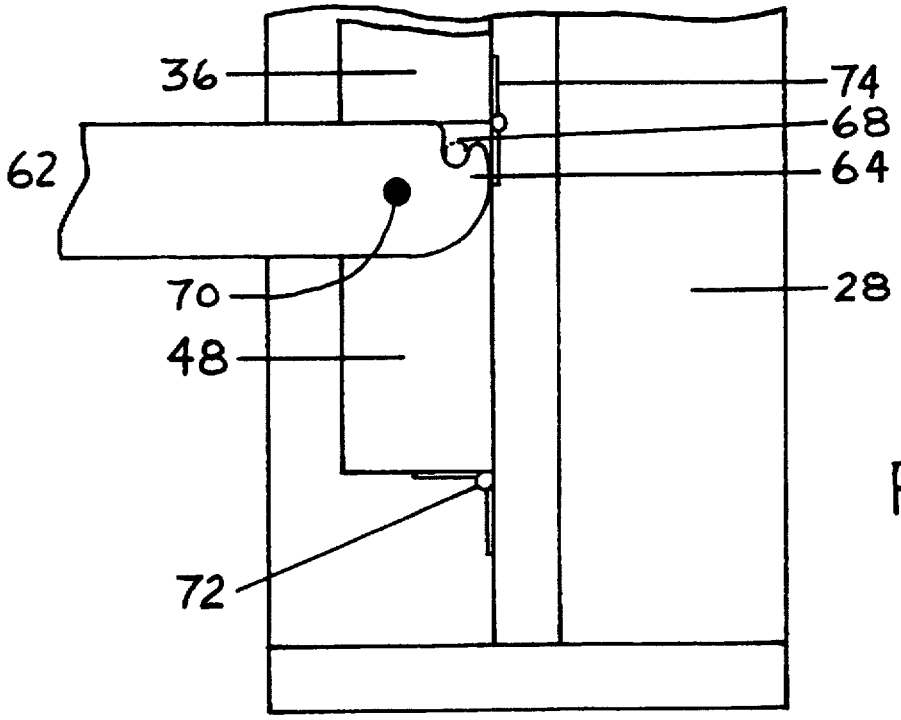
FIG. 5 is a partial cross-sectional view of the locking mechanism of FIG. 4.
Figure 4:
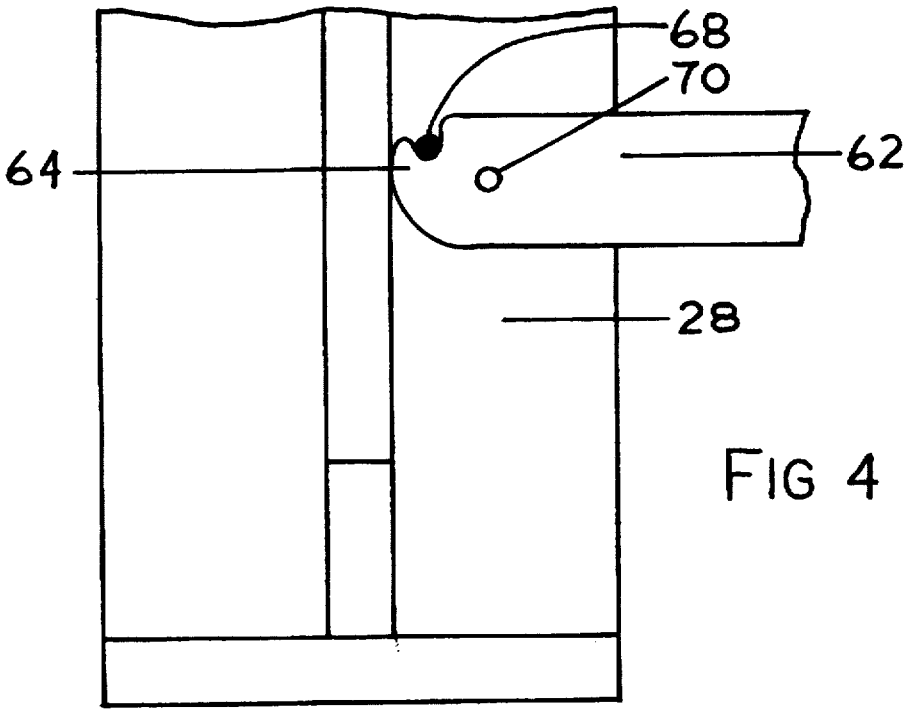
FIG. 4 is side elevation of the locking mechanism of the assembly of FIG. 1, in a closed position.

As shown more clearly in FIGS. 4 and 5, each side of locking mechanism 40 consists of a substantially horizontal extension 62 from the top of ladder 20 which is provided with a hook 64 at its end. Each hook 64 engages with a locking pin 68 (shown in hashed lines in FIG. 5) mounted to the interior of outer frame 28 at a height and depth sufficient to permit ladder 20 to be flush against an interior wall when assembly 10 is in the closed position shown in FIG. 1. The two extensions 62 are attached to the sides of drop panel 48 by pins 70 which permit drop panel 48 and extensions 62 to rotate relative to one another. Drop panel 48 is generally the same width as window 24 and forms a bottom frame to window 24 when assembly 10 is in its closed position. Drop panel 48 is provided with hinges 72 along its bottom edge, interconnecting drop panel 48 and frame 28, which permit it to rotate outwardly when assembly 10 is actuated. Drop panel 48 is further provided with hinges 74 at its upper edge. Hinges 74 link drop panel 48 to the bottom ends of tracks 36.

Figure 3:
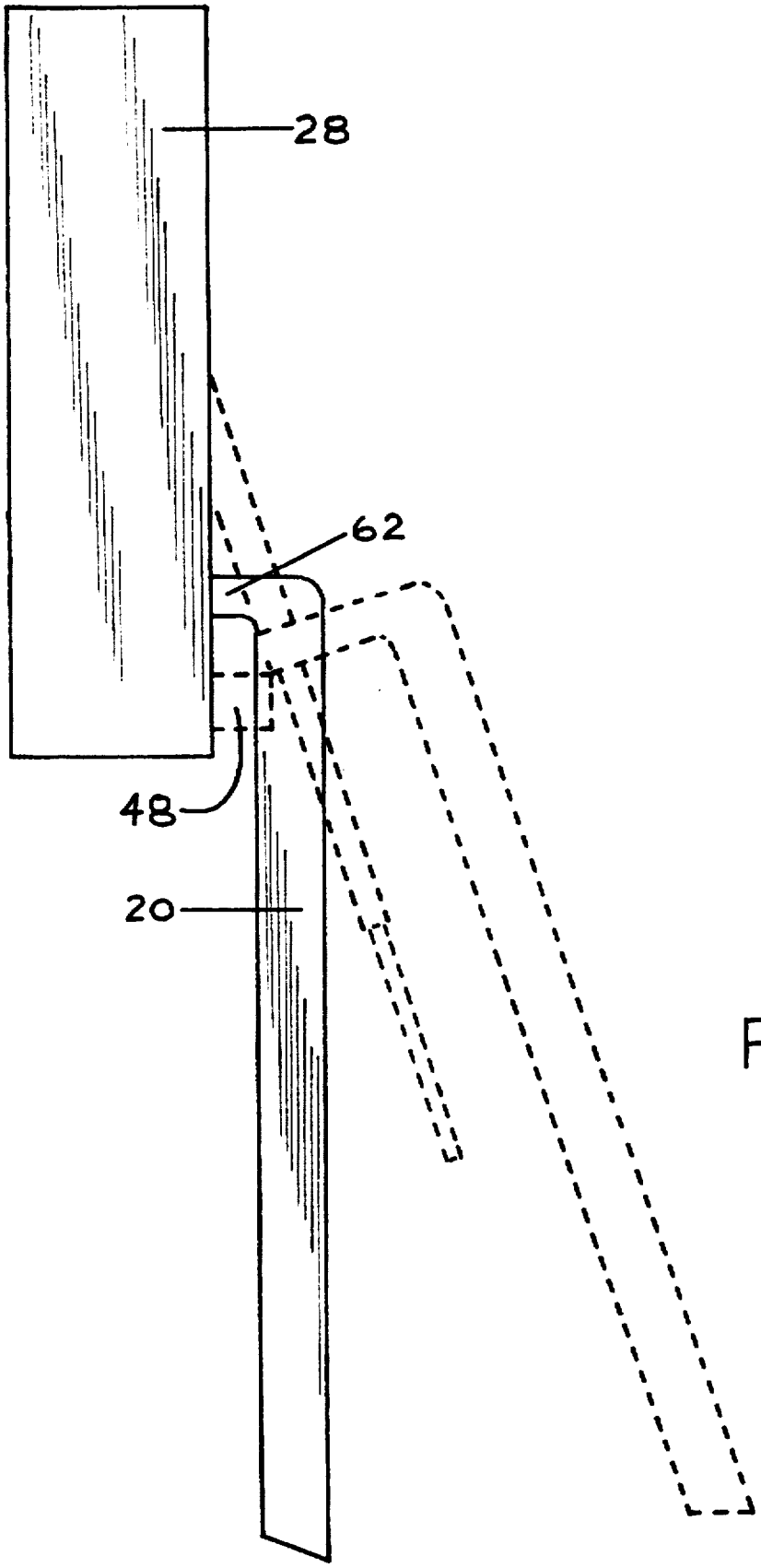
FIG. 3 is a side elevation of the assembly of FIG. 1, showing the assembly in an open position in hashed lines.

The operation of assembly 10 will now be described. In the event of an emergency, particularly a fire, an occupant of a basement apartment, described herein as a user, should take a position as close to the floor as possible to avoid the largest concentrations of smoke which rise towards the ceiling. In a typical fire, smoke, noxious gases and fear will generally disorient the user. Consequently, it is desirable to be able to locate an actuating mechanism for an emergency exit by touch. To actuate the emergency exit assembly 10 of the present invention, the user can feel along the bottom of the wall until an end 76 of ladder 20 is located. At this time assembly 10 is in a closed position, as shown in FIG. 1. The user then pulls end 76 inwardly into the room. Pulling end 76 inwardly first causes extensions 62 to pivot about pins 70 in the direction "A" in FIG. 2, thus disengaging hooks 64 from locking pins 68. As the user continues to pull end 76, the leverage provided by the length of ladder 20 causes drop panel 48 to fall inwardly about hinges 72. As it drops, the upper edge of drop panel 48 is urged pushes against the rear of tracks 36, and further pulls at the bottom ends of tracks 36 through the connection provided by hinges 74. Again, the leverage provided by the length of ladder 20 forces tracks 36 to move inwardly and to rotate about pivoting spacers 44. Window 24, held within tracks 36, is swung out with tracks 36. As tracks 36 clear outer frame 28, the force of gravity causes interior nested members 37 and 38 to descend, and along with them, window 24. Thus, by pulling end 76 away out from the wall, assembly 10 is automatically deployed and ends in an open position as shown in FIG. 2. In this open position, window 24 has dropped out of, and away from, outer frame 28, and ladder 20 is in a sloped position angled in such a way as to permit easy climbing from the floor. FIG. 3 shows assembly 10 in the closed position and in the open position (as shown by the hashed lines).

Figure 6:
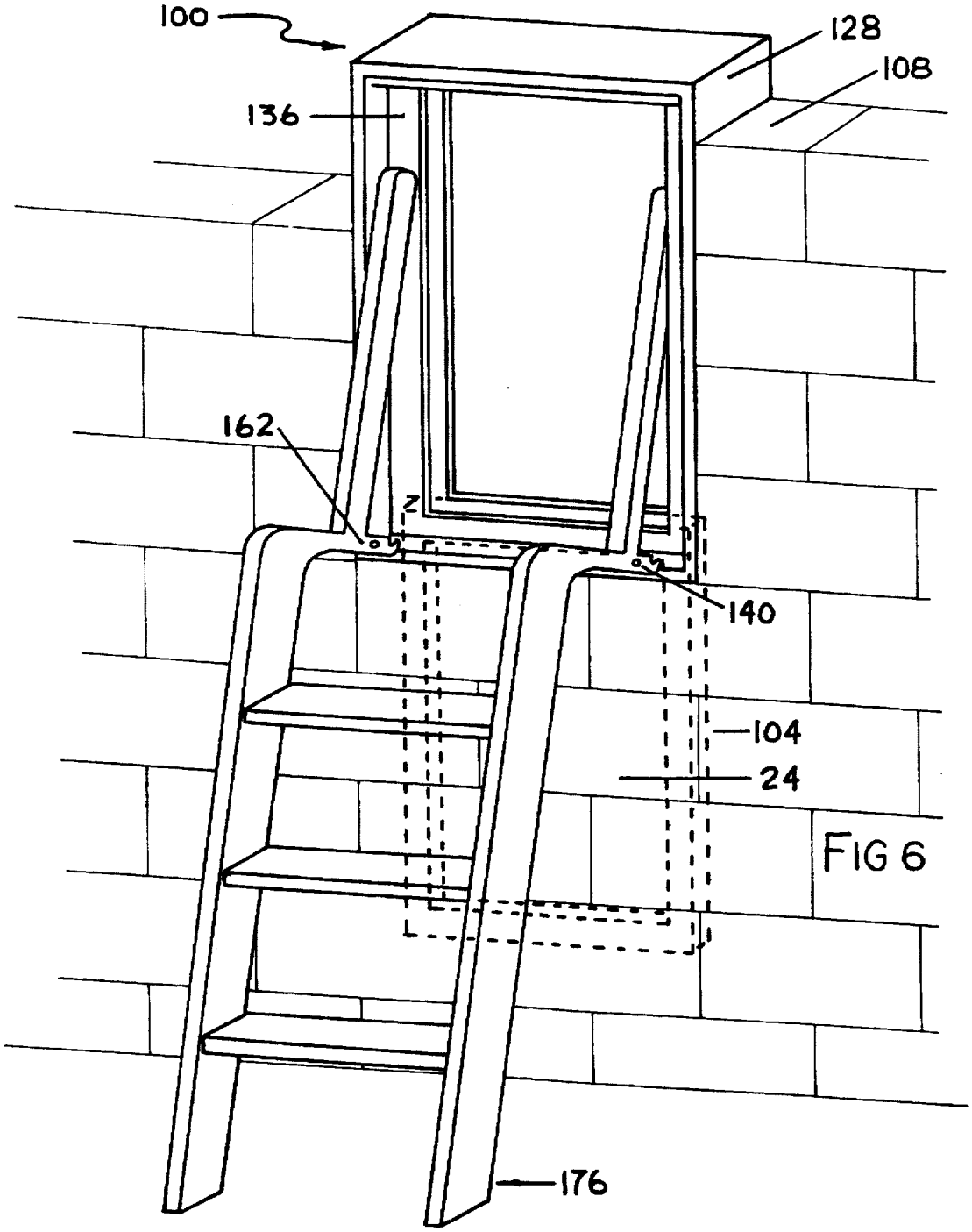
FIG. 6 is a perspective view of a basement emergency exit assembly, in accordance with a second embodiment of the present invention.

A second embodiment of the present invention is shown in FIG. 6. The emergency exit assembly of the second embodiment, generally designated as 100, operates similarly to the first embodiment described above, except that window 24 falls downwardly into a pocket 104 within a wall 108. It is contemplated by the present inventors that assembly 100 will be more suited to emergency exits which are fitted into buildings under construction, rather than retro-fitted into existing structures. Since window 24 and tracks 136 do not have to be swung inwardly as in the first embodiment, there is no need for a drop panel, nor do tracks 136 have to pivot, but they can instead be integral with an outer frame 128. In operation, a locking mechanism 140, which also serves as an actuating mechanism, is disengaged as above by pulling end 176 inwardly. Window 24, which had been supported on extensions, 162 drops into pocket 104 as extensions 162 are withdrawn inwardly.

Figure 7:
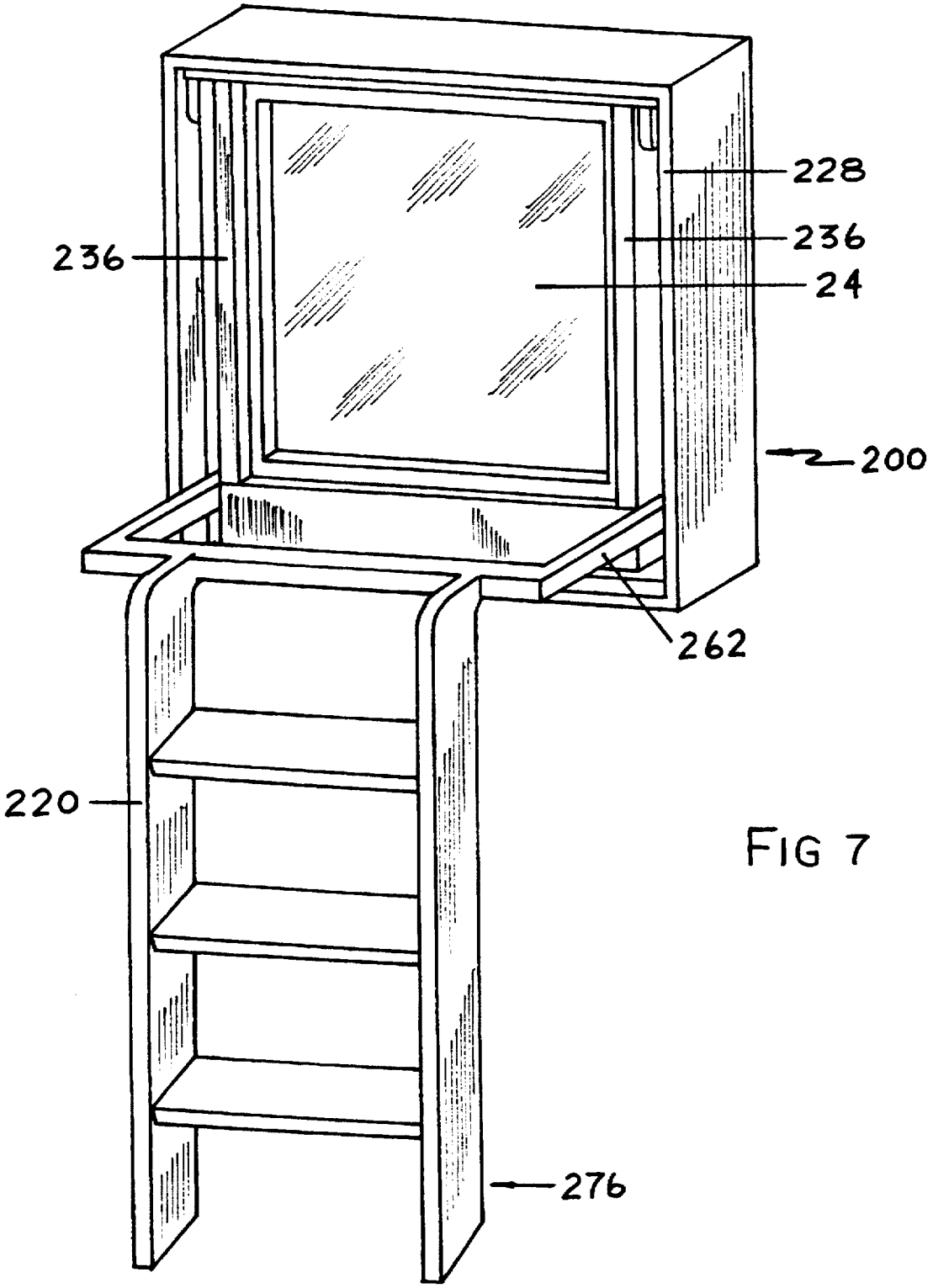
FIG. 7 is a perspective view of a basement emergency exit assembly, in accordance with a third embodiment of the present invention.

A third embodiment of the present invention is shown in FIG. 7, and generally designated as 200. In assembly 200, the drop panel present in the first embodiment has bee omitted. Instead, a U-shaped extension 262 at the upper end of a ladder 220 is directly connected to tracks 236 through a locking mechanism (not shown). In operation, as a ladder end 276 is pulled inwardly extension 262 pivots downwardly and inwardly in the direction of arrow "B". This pulls tracks 36 inwardly and permits a window 24 to drop out of a frame 228 as is described in relation to the first embodiment, above.

Advantages of the present invention will be readily apparent to those skilled in the art. The basement exit assembly 10 deploys a ladder which moves to a suitable climbing angle instead of steps fastened to the wall which would force a user to climb in a vertical position. The present invention uses sliders and spacers to move the inner frame of the window to a position below the bottom sash of the outer frame to provide a larger opening through which the user can escape. The inner frame window assembly of the present invention moves inwardly into the basement area or within the basement wall in another embodiment, where the prior art assemblies swing open to the exterior presenting the opportunity to jam against snow or other articles which may be positioned adjacent to the window. The present invention gives the user a natural physical advantage to assist in repositioning the window to the open position, thereby decreasing the opportunity for mechanical failure. In addition, the leverage provided by the length of ladder can provide enough force to break the seal between windows and frames which have been painted over, or are otherwise immobilized. The operation of the basement emergency exit assembly of the present invention is also clearly apparent and easily demonstrable to its intended users, and therefore it is likely to be readily adopted by users, landlords and municipal by-law formulators.

It will be apparent to those skilled in the art that the foregoing is by way of example only. Modifications, variations and alterations may be made to the described embodiments without departing from the scope of the invention which is defined solely in the claims.

We claim:

1. A basement emergency exit assembly for installation in an opening in a basement wall, comprising:

a window frame;

a track mounted within said frame and retaining opposing sides of a window;

a ladder pivotable about an upper end thereof to said window frame to pivot from a first position substantially flush with an inside surface of a basement wall when said assembly has been installed in an opening in said wall, and to a second position where a bottom end of said ladder is pulled inwardly in a direction away from said basement wall to provide an inclined ladder permitting access to and egress through said opening; and actuating means operably connecting to said ladder, said actuating means operable, as said ladder is moved between said first and second position, to release a bottom end of said track and permit said window to slide downwardly out of said track.

2. A assembly according to claim 1 wherein said track is inwardly pivotable about an upper pivot point on said frame.

3. A assembly according to claim 2 wherein said track comprises at least two pairs of nested track members.

4. A assembly according to claim 2 wherein said actuating means includes a drop panel pivotably attached to an upper end of said ladder.

5. A assembly according to claim 1 wherein said actuating means includes a locking mechanism wherein said locking mechanism, is unlocked when said ladder is pulled away from said wall.

6. A assembly according to claim 1 wherein said window slides into a pocket containable within said wall.

* * * * *